United States Patent [19]

Matsumoto et al.

[11] 4,199,356

[45] Apr. 22, 1980

[54] ELECTROPHOTOGRAPHIC PROCESS, OF TRANSFERRING A MAGNETIC TONER TO A COPY MEMBER HAVING AT LEAST $3\times10^{13}$ OHM-CM RESISTANCE

[75] Inventors: Shoji Matsumoto, Neyagawa; Hitoshi Nishihama, Hirakata; Tatsuo Aizawa, Osaka, all of Japan

[73] Assignee: Mita Industrial Company Limited, Osaka, Japan

[21] Appl. No.: 544,502

[22] Filed: Jan. 27, 1975

[30] Foreign Application Priority Data

Feb. 1, 1974 [JP] Japan ..... 49-13929

[51] Int. Cl.[2] ..... G03G 13/16

[52] U.S. Cl. ..... 430/126; 430/937; 430/122

[58] Field of Search ..... 427/24, 21; 96/1.4, 96/1 R, 15 D; 252/62.1

[56] References Cited

U.S. PATENT DOCUMENTS

| | | | |
|---|---|---|---|
| 2,855,324 | 10/1958 | Van Dorn | 96/1.4 |
| 2,951,443 | 9/1960 | Byrne | 96/1.4 |
| 3,093,039 | 6/1963 | Rheinfrank | 96/1.4 |
| 3,166,418 | 1/1965 | Gundlach | 96/1.4 |
| 3,166,432 | 1/1965 | Gundlach | 427/21 |
| 3,345,294 | 10/1967 | Cooper | 96/15 D X |
| 3,441,437 | 4/1969 | Epstein et al. | 252/62.1 P |
| 3,526,191 | 9/1970 | Silverberg et al. | 427/21 X |
| 3,645,770 | 2/1972 | Flint | 96/15 D |
| 3,703,376 | 11/1972 | Gundlach et al. | 96/1.4 |
| 3,748,126 | 7/1973 | Ferguson et al. | 96/1.4 |
| 3,781,105 | 12/1973 | Meagher | 96/1.4 |
| 3,784,398 | 1/1974 | Metcalfe | 96/1.4 |
| 3,820,985 | 6/1974 | Gaynor et al. | 96/1.4 |
| 3,843,381 | 10/1974 | Matsumoto et al. | 96/1.4 X |
| 3,884,687 | 5/1975 | Breck | 96/1.4 |
| 3,888,664 | 6/1975 | Carlson et al. | 96/1.4 |
| 3,933,489 | 1/1976 | Walters | 96/1.4 |
| 3,960,556 | 6/1976 | Griesmer | 96/1.4 |
| 3,992,557 | 11/1976 | Kubo et al. | 96/1.4 |

*Primary Examiner*—Roland E. Martin, Jr.
*Assistant Examiner*—John L. Goodrow
*Attorney, Agent, or Firm*—Diller, Ramik & Wight

[57] ABSTRACT

A transfer sheet on which toner images free of broadening of edge portions and having sharp contours can be transferred even in the electrophotography or electrostatic printing of the transfer type using conductive or semiconductive toners, i.e., magnetic toners, is disclosed. This transfer sheet is characterized in that a conductive or semiconductive toner-receiving face having a volume specific resistance of at least $3\times10^{13}$ Ω-cm is formed on at least one surface of a substrate of the transfer sheet.

8 Claims, 1 Drawing Figure

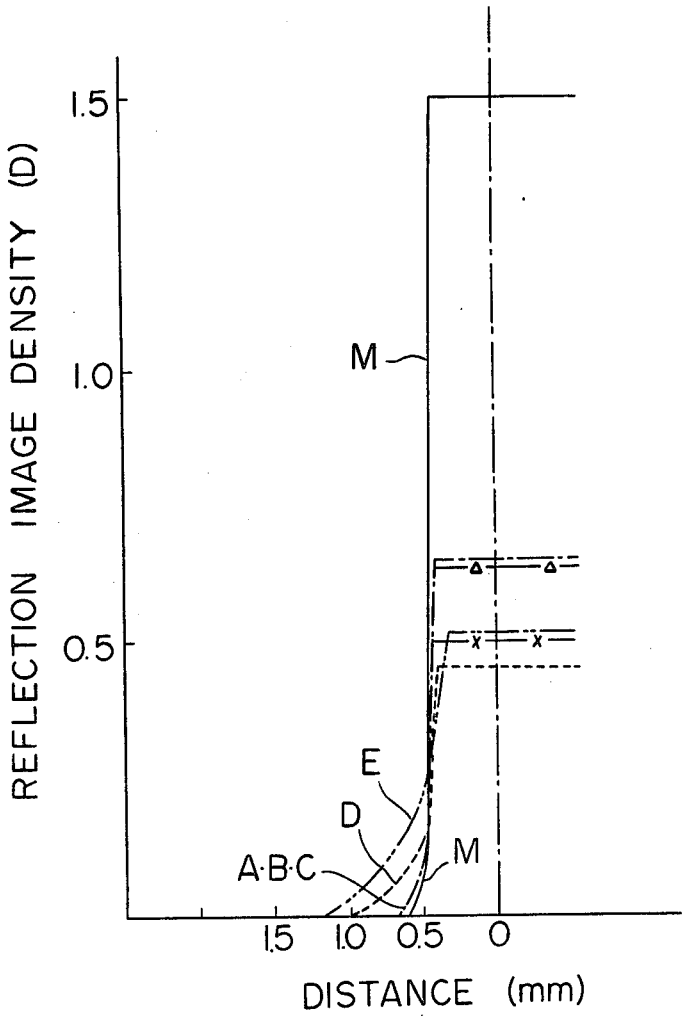
1.5
1.0
0.5
REFLECTION IMAGE DENSITY (D)
M
E
D
A·B·C
M
1.5
1.0
0.5
0
DISTANCE (mm)

ELECTROPHOTOGRAPHIC PROCESS, OF TRANSFERRING A MAGNETIC TONER TO A COPY MEMBER HAVING AT LEAST $3\times10^{13}$ OHM-CM RESISTANCE This invention relates to an electrophotographic process, an electrostatic printing process and transfer sheets for use in these processes. More particularly, the invention relates to a transfer sheet for transfer of conductive or semiconductive toner images formed on the surface of a recording material for the electrophotographic or electrostatic printing process.

the conventional electrophotographic or electrostating printing process is divided into the two types. According to one type, statically charged images are formed on the surface of a recording material, the statically charged images are converted to visible images by applying a developer on the statically charged images, the visible images are electrostatically transferred onto a transfer sheet, and the transferred images are fixed to obtain a final print. According to the other type, visible images are directly fixed on the surface of a recording material to obtain a final print. The former process is called a transfer process, and the latter process is called a direct process.

In each of the foregoing processes, there are generally employed developers comprising a carrier such as iron powder, glass bead or insulating organic solvent and a fine particulate toner composed of a binder resin and a pigment or dye. By frictional charges generated by mixing these two components in the developer, the toner is charged, for example, with a polarity opposite that of the statically charged images, and the statically charged images are converted to visible toner images by the static attraction caused between the toner particles and the statically charged images. Different methods are adopted for development depending on the kind of the carrier used. More specifically, the magnetic brush development method is adopted for iron powder, the cascade development method is adopted for glass bead and the liquid development method is adopted for insulating organic liquids.

Since the toner should be charged with a prescribed polarity by friction with the carrier, it is required that the toner of a two-component type developer should have a specific resistance of at least $10^{14}$ Ω-cm. When such an insulating toner is used in the transfer process, optional materials can be used as transfer sheets for transfer of the toner images as far as the operation efficiency is not reduced. Namely, materials in a broad range, for example, metal foils, papers and insulating films, can be optionally chosen and used. However, since prints are generally used as documents, papers, especially papers which have been rendered electrically conductive to some extent to attain good operation conditions in the copying apparatus, are generally used as transfer sheets. transfer sheets of this type are detailed in Japanese patent Publication No. 24199/71.

One-component type developers comprising a toner containing a magnetic substance, for which incorporation of a carrier is unnecessary, have recently been proposed. the magnetic brush development method is adopted for developers of this type. These one-component type developers are advantageous over the above-mentioned two-component type developers in various points. For example, scattering of the toner can be greatly reduced, and since no carrier is used, the density of the reproduced image can always be maintained at a constant level, while in the case of two-component type developers, the image density is readily changed because the ratio of the toner to the carrier is easily changed during the use. Further, the toner is applied to statically charged images in a larger amount and no edge effect is brought about. Still in addition, the one-component type developers are advantageous in that cleaning of the toner left after transfer can easily be accomplished and the size of the developing device can be reduced. However, since magnetic characteristics are inparted to these one-component type developers, specific resistances of the toners should naturally be lower than those of toners of two-component type developers and they should naturally be electrically conductive or semiconductive. Toners having a specific resistance of about $10^6$ to about $10^8$ Ω-cm are preferably employed as such conductive or semiconductive toners. These toners are detailed in, for example, specifications of U.S. Pat. No. 3,639,245 and U.S. Pat. No. 3,345,294.

When statically charged images are converted to visible images by using these conductive or semiconductive toners and reproduced images are obtained according to the transfer process, if conventional transfer sheets are used, obtained prints are defective in that contours are indefinitely broadened on the surface of the transfer sheet, namely the edge portions lack sharpness. Because of this defect, conductive or semiconductive toners are not used in the transfer process, but they are inclusively used in the direct process.

Toners used in the transfer process are required to have a sufficient charge-retaining property, and therefore, highly insulating toners are used as toners for use in the transfer process. Accordingly, the foregoing merits and advantages of conductive or semiconductive toners have not heretofore been utilized in the transfer process.

It is therefore a primary object of this invention to provide a transfer sheet on which powder images of a conductive or semiconductive toner can be transferred faithfully without substantial broadening of contours.

Another object of this invention is to provide a transfer sheet on which powder images of a conductive or semiconductive toner can be transferred faithfully and which is not different from ordinary transfer paper with respect to the toner-retaining property, the graphic property, the adaptability to sealing and the touch.

Still another object of this invention is to provide a transfer sheet on which powder images of a conductive or semiconductive toner can be transferred faithfully with good reproducibility without undergoing substantial influences of the humidity and temperature of the atmosphere.

A further object of this invention is to provide a transfer sheet for transfer of powder images of a conductive or semiconductive toner which can be prepared very easily and the manufacturing and treating costs of which are relatively low, whereby the photocopying or printing cost can be reduced.

A still further object of this invention is to provide a transfer sheet which can be applied easily and effectively, in combination with a conductive or semiconductive toner, to various modes of the electrophotographic process and electrostatic printing process of the transfer type.

The foregoing and other objects of this invention can be attained and the above-mentioned defects involved in conventional techniques can be overcome by a transfer sheet for transferring electrostatically a conductive or semiconductive toner in the electrophotographic process or electrostatic printing process, wherein a conductive or semiconductive toner-receiving face having a volume specific resistance of at least $3\times10^{13}$ Ω-cm is formed on at least one surface of a substrate.

This invention will now be described in detail.

The transfer sheet comprise in essence a substrate and a conductive or semiconductive toner-receiving face.

As the substrate, there can be used, for example, ordinary papers composed of cellulose fibers such as wood free paper and tracing paper, resin films such as transparent film, matted film and foamed film, synthetic papers prepared from artificial fibers, fabrics such as non-woven fabrics and cloths, and metals such as metal foils and metal sheets. An optional substrate is chosen from these materials depending on the use. The substrate to be used in this invention need not be rendered especially electrically conductive. Use of papers is preferred for ordinary copying.

When papers are directly used as transfer sheets for receiving powder images of a conductive or semiconductive toner, broadening of contours of the powder images is caused and the transferred images are inevitably not sharp. Further, the density of the images is inevitably reduced by diffusion of the transferred toner particles. Another defect observed when transfer sheets composed of paper are used for the electrophotographic process or electrostatic printing process is that the transfer operation is influenced by the temperature or humidity of the atmosphere and it is frequently difficult to obtain clear copies.

According to this invention, a conductive or semiconductive toner-receiving face having a specific resistance of at least $3\times10^{13}$ Ω-cm is formed on at least one surface of such paper substrate, whereby the foregoing defects involved in paper substrates are completely dissipated. This feature will be apparent from the accompanying drawing and the description given below by reference to the drawing.

The drawing is a diagram showing the image density in the vicinity of the periphery of a toner image, in which curve M shows the density of the toner image on the surface of a zinc oxide photosensitive layer before transfer, curves A, B and C show the densities of toner images transferred on transfer sheets of this invention prepared in Examples 5, 6 and 7, respectively, curve D shows the image density of the toner image transferred on a non-treated transfer sheet, and curve E shows the image density transferred on a transfer sheet having a toner-receiving face outside the scope of this invention.

As is apparent from the drawing, a toner image (sample M) formed on a zinc oxide photosensitive layer as an electrophotographic recording material has a good contrast and a high sharpness at edge portions. In contrast, a toner image (sample D) transferred on a non-treated transfer sheet composed of wood free paper has a much reduced image density and considerable broadening of image contours is caused. This tendency is also observed in the case of a transfer sheet (sample E) having a toner-receiving face formed by using a resin having a volume specific resistance outside the range specified in this invention. In contrast, in the case of transfer sheets (saples A, B and C) of this invention having a toner-image receiving face formed to have a volume specific resistance of at least $3\times10^{13}$ Ω-cm, the image density can be improved over the nontreated transfer sheet, and the sharpness at the edge portions can be maintained at a high level substantially the same as in the toner image on the photosensitive layer before transfer and broadening of image contours can be substantially prevented.

In this invention, the conductive or semiconductive toner-receiving face is formed by applying a resin, wax or oil or a mixture thereof having a volume specific resistance of at least $3\times10^{13}$ Ω-cm, especially $10^{14}$ to $10^{15}$ Ω-cm, to at least one surface of the above-mentioned substrate by coating, dipping or temporary sticking. It will readily be understood that a resin sheet meeting the above requirement of the volume specific resistance can act not only as a substrate but also as a conductive or semiconductive toner-receiving face. It is possible to use a highly humidity-absorbing sheet by removing the humidity just before transfer by heating or the like to attain a desired volume specific resistance on the surface portion. However, it is generally preferred that the volume specific resistance of the transfer sheet be not deviated from the above range under influences of the humidity or temperature of the atmosphere. For this purpose, it is preferred in this invention that such medium as resins, waxes, oils and insulating fillers are applied signly or in combination on at least one surface of a substrate sheet. As resins having such properties, there can be mentioned, for example, olefin resins such as ethylene-vinyl acetate copolymers, polyethylene, polypropylene, polybutadiene, ethylene-propylene copolymers and butadiene-styrene copolymers, acrylic resins, vinyl resins such as polyvinyl acetate, vinyl butyral and vinyl chloride resins, thermoplastic and thermosetting resins such as melamine resins, epoxy resins, alkyd resins, unsaturated polyester resins, urea resins, resin and copal, natural rubbers, and natural resins. In addition to the foregoing resins, there can be preferably used natural oils such as linseed oil, tung oil, soybean oil and sardine oil, synthetic oils such as silicone oil, polybutene oil, polycyclic aromatic oil, alkylbenzene oils, e.g., dodecylbenzene oil, mineral oil and fluorine-containing synthetic oil, and waxes such as mineral paraffin, liquid praffin, vaseline, polyethylene wax, microcrystalline wax, bees wax, montan wax and carnauba wax. These electrically insulating media such as the above-mentioned resins, electrically insulating oils and waxes can be coated on the surface of the substrate in the form of an organic solvent solution or an aqueous dispersion. The coating can be accomplished by known methods such as methods using an air doctor coater, a blade coater, a rod coater, a knife coater, a squeeze coater, a dip coater, a reverse roll coater, a transfer roll coater, a cast coater, a spray coater, a curtain coater, a calender coater, an extrusion coater or two or more of these coaters. It is especially preferred that the above-mentioned resin, insulating oil or wax be coated in a thickness as small as possible so as not to change greatly properties of the substrate such as touch. The amount coated of the resin, insulating oil or wax is changed considerably depending on the kind of the electrically insulating medium coated, but it is generally preferred that the amount coated of the insulating medium as calculated as the non-volatile component be within a range of from 0.3 to 50 g/m$^2$, especially 0.5 to 20 g/m$^2$. When the amount coated is smaller than 0.3 g/m$^2$, it is difficult to render the sheet surface sufficiently electrically insulating, and it is impossible to transfer faithfully the conductive or semiconductive toner. More specifically, when the amount coated of the insulating medium is smaller than 0.3 g/m$^2$, the transfer of the conductive or semiconductive toner does not substantially differ from the transfer performed by using a non-treated substrate sheet, and obtained copied images have indefinite contours, namely they have no sharpness at edge portions. We consider that the reason why copied images are indefinite in such case will be as follows:

When visible images formed by developing statically charged images fromed on the surface of the recording material with a conductive or semiconductive toner are superposed on a transfer sheet having a toner-receiving layer having a volume specific resistance lower than $3\times10^{13}$ Ω-cm and an electric field is applied to the assembly from the back face of the transfer sheet, on transfer of the toner onto the transfer sheet electric charge neutralization is caused to occur between the toner particles and the transfer sheet, and the elctrostatic attraction between the transfer sheet and the toner particles is lost, resulting in diffusion or scattering of the toner particles into neighbourhoods of the edge portions of the images. In contrast, in case a transfer sheet having a toner-receiving face of a volume specific resistance of at least $3\times10^{13}$ Ω-cm formed on the surface of a substrate by coating an electrically insulating medium such as the above-mentioned resins, waxes or oils in an amount coated of at least 0.3 g/m$^2$ is employed, the electric charge meutralization is not caused to occur between the particles of a conductive or semiconductive toner and the transfer sheet even after the image transfer and the charge of a polarity opposite the polarity of the toner is sufficiently retained on the transfer sheet. Accordingly, a sufficient electrostatic attraction can be retained between the toner and the transfer sheet, and therefore, faithful transfer can be attained.

The electrostatic attraction-retaining property of the transfer sheet can be expressed in terms of the charge characteristics of the sheet as well as the volume specific resistance. The transfer sheet of this invention having a conductive or semiconductive toner-receiving face having a volume specific resistance of at least $3\times10^{13}$ Ω-cm has such charge characteristics that if corona discharge of about 6 KV is applied on the transfer sheet by using an electrophotographic copying paper testing machine of the Model SP-428 manufactured by Kawaguchi Denki K. K. and application of the corona discharge is stopped when the surface potential of the sheet is saturated, the potential on the surface of the sheet is at least 15 to 20 V.

When the amount coated of the electrically insulating medium exceeds 10 g/m$^2$, properties of the substrate of the transfer sheet are greatly changed and handling of the transfer sheet in a copying machine becomes difficult. Especially, peeling of the transfer sheet from the surface of the recording material becomes difficult. Further, properties desirable for the transfer sheet are lost. Especially when the substrate is paper, in order to retain properties of paper as the transfer sheet, such as the toner-retaining property, the graphic property, the adaptability to stamping and the touch, it is necessary that the amount coated of the electrically insulating medium should be kept at a low level.

In order to improve the toner-retaining property, the graphic property, the adaptability to stamping and the touch, it is possible to incorporate into the above-mentioned coating composition white pigments such as titanium dioxide, silica powder, zinc oxide, magnesium silicate, barium sulfide, barium carbonate, calcium carbonate, zinc sulfide, white lead, alumina white and clay. When it is desired to obtain a colored transfer sheet, it is possible to incorporate into the coating composition a coloring filler or dye such as Benzidine Yellow, Chrome Yellow, Cyanine Blue, Sky Blue, Rose Bengale, Brilliant Carbine 6B and Rose Fanal Lake in an amount of 10 to 200 parts by weight per 100 parts be weight of the insulating resin, oil or wax.

Still further, in order to control the drying rate of the composition coated on the surface of the sheet, it is possible to add a drier and an inhibitor to the coating composition.

The viscosity of the viscous coating composition obtained by mixing an insulating medium such as the abovementioned resins, oils or waxes with additives such as pigments can be optionally chosen depending on the coating method or the touch or other properties of the transfer sheet. For example, when a composition having a viscosity lower than 1 poise is coated on paper as substrate, it permeates into the paper at a high rate, and if it is coated on a paper substrate according to the dip coating method, a semi-transparent transfer sheet resembling tracing paper can be obtained. In the case of a coating composition having a viscosity exceeding 2000 poises, permeation into paper can be inhibited to some extent. In this case, use of a rod coater or a squeeze coater is not preferred but a granure coater or a reverse roll coater including 3 or 4 rolls is suitable.

The toner-receiving face is generally formed on one surface of the substrate, but if it is desired to obtain transfer sheets on both the surfaces of which images are transferred, the toner-receiving face is formed on each of the surfaces of the substrate.

The so formed transfer sheet is valuable as a transfer sheet for receiving thereon toner particles, especially particles of a conductive or semiconductive toner, from the surface of the recording material. Conductive or semiconductive toners are generally composed of toner particles having a specific resistance ranging from about $10^3$ to about $10^{10}$ Ω-cm. These toners are commercially available as magnetic toners, and when these toners are employed, statically charged images on the surface of the recording material can be developed according to the magnetic brush development method without using a magnetic carrier such as iron powder. These toners are composed of particles prepared, for example, by dispersing a powder of a ferromagnetic substance and a powder of a pigment into a hot-meltable resin. Those having a particle size of 5 to 50μ are preferably employed. As the resin constituting the binder layer for the toner particles, there are generally employed a phenol-formaldehyde resin, a rosin-modified phenol-formaldehyde resin, polystyrene, a butadiene-styrene copolymer, asphalt, rosin, a vinyl chloride resin, a vinyl acetate resin, an acrylic resin, an epoxy resin, etc.

As the ferromagnetic substance, there are preferably employed iron, iron alloys and iron alloys such as iron sesquioxide, iron tri-iron tetroxide, ferrite, nickel-iron alloys and nickel-cobalt-iron alloys, cobalt, and cobalt alloys such as Alnico, iron-nickel-cobalt alloys and cobalt-platinum-manganese alloys. Further, magnetic alloys of aluminum, silver, copper, magnesium, manganese or the like, and iron garnets such as yttrium-iron garnets and ytterbium-iron garnets can be used as ferromagnetic substances. As the pigment, there are generally employed carbon black, Nigrosine dyes, Aniline Blue, Calco Oil Blue, Chrome Yellow, Ultramarine Blue, Quinoline Yellow, Methylene Blue Chloride, Monastral Blue, Malachite Green Oxalate, Rose Bengale, Monastral Red, and mixtures of two or more of these pigments.

A preferred composition of the conductive or semiconductive toner is as follows:

Resin binder—30 to 60% by weight
Ferromagnetic powder—30 to 60% weight
Pigment—0.5 to 2% weight In practising the electrophotographic process by using the transfer sheet of this invention, images of a conductive or semiconductive toner are first formed on the surface of a recording material according to, for example, the following methods:

A known electrophotographic recording material composed mainly of a photoconductor such as zinc oxide and selenium is charged by a charging device, for example, a corona discharge device. The charged recording material is then exposed to light imagewise to form on the surface of the recording material statically charged images corresponding to light images. A conductive or semiconductive toner is applied to the statically charged images according to the magnetic brush development method.

According to an alternative method, a corona discharge of a specific polarity is applied to a laminate recording material comprising as basic layers a light-transmitting insulating layer, a photoconductive layer and a conductive layer, the recording material is exposed to light imagewise and simultaneously, a corona discharge of a direct current, an alternating current or an asymmetric alternating current is applied thereto, and then, the recording material is exposed to actinic rays uniformly throughout the entire surface to thereby form statically charged images. A conductive or semiconductive toner is applied to the statically charged images according to the magnetic brush development method to thereby form toner images.

According to another method, images of an insulating toner are formed on the surface of an electrophotographic recording material having a coating of a photoconductor such as zinc oxide by menas known per se, and the toner images are fixed on the surface of the recording material. Then, this recording material having the insulating toner images fixed on the surface thereof (called "master for electrostatic printing") is charged again and the entire surface is exposed to actinic rays uniformly. By this irradiation, surface charges are dissipated at areas having no toner images, but surface charges are left at toner image areas, whereby statically charged images corresponding to the toner images are formed on the surface of the recording material. A conductive or semiconductive toner is applied to the statically charged images according to the magnetic brush development method, and images of the conductive or semiconductive toner are formed on the fixed images of the insulating toner. This method is generally called "electrostatic printing process". In this method, it is possible to use a recording material having a permanent pattern formed on a recording layer by utilizing the difference of the conductivity instead of the above-mentioned electrophotographic material having fixed toner images thereon. This technique is generally called "electrostatic chemography".

The images of the conductive or semiconductive toner formed according to any of the foregoing methods are then transferred on the transfer sheet of this invention. The transfer can be accomplished according to any of the known methods. For example, the toner-receiving face of the transfer sheet of this invention is contacted with the conductive or semiconductive toner images and a voltage is applied to the back face of the sheet by corona discharge or the like, whereby the conductive or semiconductive toner is transferred to the transfer sheet from the surface of the recording material. As the degree of pulsation is lower in the applied voltage, diffusion or scattering of the conductive or semiconductive toner to the peripheral portions of the images is more reduced.

This invention will now be illustrated in detail by reference to the following Examples and Comparative Examples, in which all of "%" and "parts" are by weight.

EXAMPLE 1

Preparation of Transfer Sheet

A 20% solution of an acrylic resin (LR-472 manufactured by Mitsubishi Rayon K. K.) in toluene was coated on the surface of an aluminum sheet having a thickness of 50$\mu$ and dried to obtain a transfer sheet in which the amount coated of the acrylic resin was 4.25 g/m$^2$. The volume specific resistance of toner receiving face of the transfer sheet was $3.78\times10^{14}$ $\Omega$-cm.

Electrophotography

A commerically available photosensitive paper for electrophotography ("Copystar Fax Paper" manufactured by Mita Kogyo K. K.) comprising a zinc oxide coating layer as a photoconductive layer was charged by corona discharge so that the surface potential of the photosensitive layer was $-350$ to $-400$ volts, and the charged photosensitive paper was exposed imagewise to actinic rays to form statically charged images on the surface of the photosensitive layer.

The conductive or semiconductive toner used for development was prepared in the following manner:

1 parts of an epoxy resin (Epichlon 4050 manufactured by Dainippon Ink K. K.) was melt-kneaded with 1 part of tri-iron tetroxide (manufactured by Toyo Shikiso K. K.) by means of a hot roll mill to disperse the iron oxide uniformly in the resin. The dispersion was cooled and pulverized. The purverized product was passed through a high temperature air current (500° C.) to mold it into spheres, and the spheres were sieved to obtain particles having an average particle size of 15$\mu$. The so obtained particles were dry-blended with 0.02 part of carbon black, and the blend was passed through a high temperature air current to mold it into spheres. The spheres were sieved to obtain a conductive or semiconductive toner having a volume specific resistance of $5\times10^8$ $\Omega$-cm and an average particle size of about 15$\mu$.

The so obtained conductive or semiconductive toner was supplied to the developing zone as a magnetic brush having a spike length of about 1 mm and contacted with the static image-carrying surface of the photosensitive layer to form toner images which had the reflection image density shown by the curve M in the accompanying drawing.

Then, the surface coating layer of the above transfer sheet was superposed on the toner images of the photosensitive layer, and corona discharge of about 6.5 KV was applied to the back surface of the transfer sheet and the transfer sheet having the toner images transferred thereon was peeled from the photosensitive layer to thereby accomplish the image transfer. The transfer sheet was passed through a heater to fix the images. The so obtained copy had images of sharp contours.

EXAMPLE 2

A 35% solution of a silicone resin (KR-214 manufactured by Shinetsu Kagaku K. K.) in toluene was coated on the surface of an aluminum sheet having a thicknes of 50μ and dried to obtain a transfer sheet in which the amount coated of the silicone resin was 8.65 g/m$^2$. In the same manner as described in Example 1, images of a conductive or semiconductive toner were transferred to the toner-receiving face of the so obtained transfer sheet. Good copied images were obtaned. The volume specific resistance of the toner-receiving face of the transfer sheet was $7.02\times10^{16}\Omega$-cm.

EXAMPLE 3

A 20% solution of an acrylic resin (LS-701 manufactured by Fujikura Kasei K. K.) in toluene was coated on the surface of an aluminum sheet having a thickness of 50μ and dried to obtain a transfer sheet in which the amount coated of the acrylic resin was 4.92 g/m$^2$. In the same manner as described in Example 1, images of a conductive or semiconductive toner were transferred on the toner-receiving face of the transfer sheet. Good copied images were obtained. The volume specific resistance of the toner-receiving face of the transfer sheet was $2.91\times10^{15}\Omega$-cm.

EXAMPLE 4

60 g of a polyvinyl acetate resin (in the form of a 10% solution in methanol), 40 g of zinc oxide and 20 cc of acetone as a diluent solvent were mixed together for several hours by a ball mill to disperse zinc oxide sufficiently and homogeneously in the polyvinyl acetate resin, and the resulting dispersion was coated on the surface of an aluminum substrate having a thickness of about 50μ and dried to obtain a transfer sheet in which the amount coated of the coating material was 21.5 g/m$^2$. In the same manner as described in Example 1, images of a conductive or simiconductive toner were transferred on the toner-receiving face of the so obtained transfer sheet. Good copied images were obtained. The volume specific resistance of the toner-receiving face was $3.93\times10^{13}\Omega$-cm.

EXAMPLE 5

A 20% solution of the same resin as used in Example 1 in toluene was coated on the surface of wood free paper having a thickness of about 70μ and dried to obtain a transfer sheet (sample A) in which the amount coated of the resin was 7.27 g/m$^2$. In the same manner as described in Example 1, images of a conductive or semiconductive toner were transferred on the toner-receiving face of the so obtained transfer sheet. Good copied images were obtained. The volume specific resistance of the toner-receiving face of the transfer sheet was $1.97\times10^{16}\Omega$-cm.

In order to examine the state of scattering of the toner particles of the toner images transferred to the transfer sheet, the reflection image density of a black image of an area of about 1 cm×about 1 cm as measured at edge portions of the image to obtain the density distribution as shown by the curve A in the accompanying drawing. The image density as measured with respect to edge portions of the corresponding toner image (non-fixed) formed on the surface of the zinc oxide recording material before the transfer had the distribution as shown by the curve M in the accompanying drawing. The densitometer used for determination of the density was a Sakura Microdensitometer of the Model PDM-5.

EXAMPLE 6

A 35% solution of the same resin as used in Example 2 in toluene was coated on the surface of wood free paper having a thickness of about 70μ and dried to obtain a transfer sheet (sample B), of which the volume specific resistance of the toner receiving face is $5.26\times10^{14}\Omega$-cm in which the amount coated of the resin was 12.4 g/m$^2$. In the same manner as described in Example 1, images of a conductive or semiconductive toner were transferred to the toner-receiving face of the so obtained transfer sheet. Good copied images were obtained. The transfer sheet was not different from untreated paper with respect to the toner-retaining property, the graphic property, the adaptability to stamping and the touch. The transfer sheet was especially excellent in the transfer efficiency. In the same manner as described in Example 5, the state of scattering of the toner particles of the toner images transferred to the transfer sheet was determined to obtain results shown by the curve B in the accompanying drawing, which were as good as results obtained in Example 5 (sample A).

EXAMPLE 7

An alkyd resin (Aroplats 1700 manufactured by Nisshoku Arrow Kagaku K. K.) was coated and dried on the surface of wood free paper having a thickness of about 70μ to obtain a transfer sheet (sample C) in which the amount coated of the resin was 2.78 g/m$^2$. In the same manner as described in Example 1, images of a conductive or semiconductive toner were transferred to the toner-receiving face of the transfer sheet. Good copied images were obtained. This transfer sheet was not different from untreated paper with respect to the toner-retaining property, the graphic property, the adaptability to stamping and the touch. The volume specific resistance of the toner-receiving face of the transfer sheet was $8.25\times10^{14}\Omega$-cm. The state of scattering of the toner particles of the toner images transferred to the transfer sheet was measured in the same manner as in Example 5, to obtain results as shown by the curve C in the accompanying drawing, which were as good as obtained in Examples 5 and 6 (samples A and B).

EXAMPLE 8

A silicone oil (Silicone Oil L-45 #1000 manufactured by Nippon Unicar K. K.) was coated on the surface of wood free paper having a thickness of about 70μ to obtain a transfer sheet in which the amount coated of the resin was 10.4 g/m$^2$. In the same manner as described in Example 1, images of a conductive or semiconductive toner were transferred to the toner-receiving face of the transfer sheet to obtain copied images as good as copied images obtained in Examples 5, 6 and 7 (samples A, B and C). This transfer sheet was not different from untreated paper with respect to the toner-retaining property, the graphic property, the adaptability to stamping and the touch. The volume specific resistance of the toner-receiving face of the transfer sheet was $2.65\times10^{14}\Omega$-cm.

EXAMPLE 9

Linseed oil (manufactured by Yamakatsura K. K.) was coated on wood free paper having a thickness of about 70μ to obtain a transfer sheet in which the amount coated of the oil was 14.4 g/m$^2$. In the same manner as described in Example 1, images of a conductive or semiconductive transfer sheet were transferred to the toner-receiving face of the transfer sheet to obtain copied images as good as obtained in Examples 5, 6 and 7 (samples A, B and C). The transfer sheet was not different from untreated paper with respect to the toner-retaining property, the graphic property, the adaptability to stamping and the touch. The volume specific resistance of the toner-receiving face of the transfer sheet was $6.68\times10^{13}\Omega$-cm.

EXAMPLE 10

An aqueous solution comprising 35% of an acrylic resin emulsion (Mowinil 710 manufactured by Hoechst AG.) and 5% of silica was coated on the surface of wood free paper having a thickness of 70$\mu$ and dried to obtain a transfer sheet in which the amount coated of the coating material was about 100 g/m$^2$. In the same manner as described in Example 1, images of a conductive or semiconductive toner were transferred to the toner-receiving face of the transfer sheet to obtain copied images as good as samples A, B and C. The transfer sheet was slightly inferior to untreated paper with respect to the toner-retaining property, the graphic property, the adaptability to stamping and the touch. The volume specific resistance of the toner-receiving face of the transfer sheet was $6.1\times10^{14}\Omega$-cm.

EXAMPLE 11

A 35% solution of a silicone resin (KR-214 manufactured by Shinetsu Kagaku K. K.) in toluene was coated on tracing paper having a thickness of about 50$\mu$ and dried to obtain a transfer sheet in which the amount coated of the resin was 9.75 g/m$^2$. In the same manner as described in Example 1, images of a conductive or semiconductive toner were transferred to the toner-receiving face of the transfer sheet to obtain copied images as good as samples A, B and C. The transfer sheet was excellent in the toner-retaining property, the graphic property and the adaptability to stamping, and it was not substantially different from untreated tracing paper in these properties. The volume specific resistance of the toner-receiving face of the transfer sheet was $9.8\times10^{14}\Omega$-cm.

EXAMPLE 12

An alkyd resin (Aroplats 1700 manufactured by Nisshoku Arrow Kagaku K. K.) was coated on tracing paper having a thickness of about 50$\mu$ to obtain a transfer sheet in which the amount coated of the resin was 4.65 g/m$^2$. In the same manner as described in Example 1, images of a conductive or semiconductive toner were transferred to the toner-receiving face of the transfer sheet to obtain copied images as good as samples A, B and C. The tansfer sheet was excellent in the toner-retaining property, the graphic property and the adaptability to stamping, and it was not different from untreated tracing paper in these properties. This transfer sheet could be used effectively as a second original for the diazo-type reproduction. The volume specific resistance of the toner-receiving face of the transfer sheet was $5.78\times10^{14}\Omega$-cm.

EXAMPLE 13

A silicone oil (L-45 #1000 manufactured by Nippon Unicar K. K.) was coated on a tracing paper having a thickness of about 50$\mu$ to obtain a transfer sheet in which the amount coated of the oil was 7.96 g/m$^2$. In the same manner as described in Example 1, images of a conductive or semiconductive toner were transferred to the toner-receiving face of the transfer sheet to obtain copied images as good as in samples A, B and C. The transfer sheet was excellent in the toner-retaining property, the graphic property and the adaptability to stamping, and ti was not different from untreated tracing paper in these properties. The volume specific resistance of the toner-receiving face of the transfer sheet was $5.04\times10^{14}\Omega$-cm.

EXAMPLE 14

Linseed oil (manufactured by Yamakatsura K. K.) was coated on tracing paper having a thickness of about 50$\mu$ to obtain a transfer sheet in which the amount coated of the oil was 11.3 g/m$^2$. In the same manner as described in Example 1, images of a conductive or semiconductive toner were transferred on the toner-receiving face of the transfer sheet to obtain copied images as good as in samples A, B and C. The transfer sheet was excellent in the toner-retaining property, the graphic property and the adaptability to stamping, and it was not different from untreated tracing paper in these properties. The volume specific resistance of the toner-receiving face was $5.6\times10^{13}\Omega$-cm.

EXAMPLE 15

A polyethylene terephthalate film (having a volume specific resistance higher than $10^{16}\Omega$-cm) having a thickness of about 50$\mu$ was used as a transfer sheet, and in the same manner as described in Example 1, images of a conductive or semiconductive toner were transferred to the surface of this transfer sheet to obtain substantially good copied images. The transferred conductive or semiconductive toner was locally diffused to some extent by anomalous discharge caused locally when the transfer sheet was peeled from the zinc oxide recording material.

EXAMPLE 16

An alkyd resin (Aroplats 1700 manufactured by Nisshoku Arrow Kagaku K. K.) was coated on the surface of a polyethylene terephthalate film having a thickness of about 50$\mu$ and dried to obtain a transfer sheet in which the amount coated of the resin was 4.62 g/m$^2$. In the same manner as described in Example 1, images of a conductive or semiconductive toner were transferred on the toner-receiving resin-coated face of the transfer sheet to obtain copied images as good as in sample C. When the transfer sheet was peeled from the zinc oxide recording material, no anomalous discharge was caused, which means that the volume specific resistance of the toner-receiving face of the Mylar film was rendered substantially equal to the volume specific resistance of the toner-receiving face of sample C.

EXAMPLE 17

A commercially available photosensitive paper (Copystar Fax Paper manufactured by Mita Kogyo K. K.) having a zinc oxide coating layer as a photoconductive layer was charged by corona discharge so that the surface potential of the photosensitive layer was −350 to −400 volts, and the photosensitive layer was exposed imagewise to acitnic rays to form static latent images. The static image-carrying photosensitive layer was contacted with a magnetic brush composed of iron powder and an insulating toner having a volume specific resistance of about $10^{14}$ and about $10^{16}$ Ω-cm to form toner images. Then, the toner images were heated and fixed to obtain an electrostatic printing master having an insulating toner pattern. The master was charged again by corona discharge so that the surface potential was −350 to −400 volts, and the entire surface of the master was exposed to actinic rays to form charged images corresponding to the above insulating toner images. The charged images were developed with the same conductive or semiconductive toner as described in Example 1 and the resulting toner images were transferred to the same transfer sheet as used in Example 7 (sample C) to obtain a good print.

EXAMPLE 18

A red viscous composition comprising 24.7 parts of Brilliant Carmine 6B, 6.0 parts of Rose Fanal Lake, 13.5 parts of Cloth White, 10.4 parts of 15P varnish, 45.0 parts of 60 P varnish and 0.4 part of lead borate and manganese was coated on wood free paper having a thickness of about 50μ in an amount of about 1.2 g/m$^2$ by a granure coater to obtain a red transfer sheet. In the same manner as described in Example 1, images of a conductive or semiconductive toner were transferred to the toner-receiving face of the transfer sheet to obtain copied images as good as in samples A, B and C.

COMPARATIVE EXAMPLE 1

Wood free paper (sample D) having a thickness of 70μ was used as a transfer sheet, and in the same manner as described in Example 1, images of a conductive or semiconductive toner were transferred to one surface of the transfer sheet. Contours of the copied images were indefinite and the scattering or diffusion the toner particles was observed in the copied images. The state of scattering of the toner images transferred to the transfer sheet was examined in the same manner as in Example 5 to obtain the density distribution as shown by the curve D in the drawing. The volume specific density of the toner-receiving face of the transfer sheet was $4.0\times10^{12}$Ω-cm.

COMPARATIVE EXAMPLE 2

A conductive resin (Eslex W manufactured by Sekisui Kagaku K. K.) was coated on wood free paper having a thickness of about 70μ and dried to obtain a transfer sheet (sample E) in which the amount coated of the resin was 3.2 g/m$^2$. In the same manner as described in Example 1, images of a conductive or semiconductive conductor were transferred to the toner-receiving face of the transfer sheet. The degree of scattering and diffusion of the toner particles was extremely high and contours of the copied image were indefinite. The scattering state of the toner images was examined in the same manner as in Example 5 to obtain the density distribution as shown by the curve E in the drawing. The volume specific resistance of the toner-receiving face of the transfer sheet was $2.8\times10^{12}$Ω-cm.

COMPARATIVE EXAMPLE 3

Untreated tracing paper having a thickness of about 50μ was used as a transfer sheet. In the same manner as described in Example 1, images of a conductive or semiconductive toner were transferred to the surface of the transfer sheet. The degree of scattering or diffusion of toner particles in the copied images was a little higher than in sample D, and contours of the copied images were indefinite. The volume specific resistance of the toner receiving face of the transfer sheet was $1.11\times10^{13}$Ω-cm.

What is claimed is:

1. An electrophotographic process comprising the steps of charging a photoconductive layer of an electrophotographic recording material and exposing the charged photoconductive layer imagewise to light to thereby form an electrostatic latent image corresponding to the light image, contacting the photoconductive layer carrying thereon the so formed electrostatic latent image with a magnetic brush composed of a conductive or semiconductive magnetic toner to thereby form on the photoconductive layer a toner image corresponding to the electrostatic latent image, and contacting the photoconductive layer carrying the so formed toner image thereon with a transfer sheet to thereby transfer electrostatically the image of the conductive or semiconductive toner to the transfer sheet, wherein the said conductive or semiconductive magnetic toner has a specific resistance ranging from about $10^3$ to about $10^{10}$ ohm-cm, said transfer sheet comprises a paper substrate and a toner-receiving face layer of at least one medium selected from the group consisting of resins, waxes and oils, each having a volume specific resistance of at least $3\times10^{13}$ Ω-cm, said toner-receiving face layer being formed by applying said medium on the paper substrate in an amount of 0.3 to 50 g/m$^2$, and the transfer of the toner image to said toner-receiving face layer is accomplished by application of a voltage to the back face of the transfer sheet by corona discharge without substantial broadening of contours.

2. In the method of producing a visual image on a copy member which comprises the steps of forming a latent electrostatic image on a photoconductive member, applying a toner to said photoconductive member to provide a transferrable visual image corresponding to said latent image, and transferring said toner from said photoconductive member to a front face of said copy member, the improvement wherein:

(a) said toner is a conductive or semiconductive magnetic toner having a specific resistance ranging from about $10^3$ to about $10^{10}$ ohm-cm;

(b) said transferring is effected by subjecting the back face of said copy member to corona discharge; and (c) said copy member is a transfer sheet comprising a paper substrate and a toner-receiving face layer of at least one medium selected from the group consisting of resins, waxes and oils, each having a volume specific resistance of at least $3\times10^{13}$ Ω-cm, said medium being applied on said paper substrate in an amount of 0.3 to 50 g/m$^2$.

3. In an electrophotographic process according to claim 2 wherein the toner-receiving face layer of the transfer sheet has a volume specific resistance of $10^{14}$ to $10^{15}$ Ω-cm.

4. In an electrophotographic process according to claim 2 wherein the medium is a silicone-modified resin having a volume specific resistance of $10^{14}$ to $10^{15}$ Ω-cm.

5. In an electrophotographic process according to claim 2 wherein the conductive or semiconductive toner to be transferred from the photoconductive layer to the conductive or semiconductive toner-receiving face of the transfer sheet is a powdery composition comprising 30 to 60% by weight of a resin binder, 30 to 60% by weight of a magnetic powder and 0.5 to 2% by weight of a pigment, each % by weight being based on the total toner.

6. An electrophotographic process comprising the steps of:

(a) forming an electrostatic latent image on a photoconductive surface of a recording medium;

(b) forming a toner image on said photoconductive surface corresponding to said electrostatic image thereon by magnetically brushing a magnetic toner having a specific resistance ranging from about $10^3$ to about $10^{10}$ ohm-cm onto said photoconductive surface;

(c) transferring said toner image to a toner-receiving surface of a transfer sheet by contacting said toner-receiving surface of the transfer sheet in face-to-face contact with said photoconductive surface having said toner image thereon and applying a voltage by means of corona discharge to that surface of the transfer sheet opposite said toner-receiving surface; and the improvement which comprises the step of:

(d) controlling the transfer of step (c), such that the toner image transferred to said toner-receiving surface is effected without substantial broadening thereof with respect to the contours of said toner image on said photoconductive surface, by providing said transfer sheet in the form of a substrate having a coating applied to a surface thereof at a coating weight of 0.3–50 g/m$^2$ to provide said toner-receiving surface, said coating being selected from the group consisting of waxes, resins and oils having a volume specific resistance of at least $3\times10^{13}$ Ω-cm.

7. An electrophotographic process as defined in claim 6 wherein said substrate is an aluminum sheet.

8. An electrophotographic process as defined in claim 6 wherein said substrate is a wood-free paper.

* * * * *